US008109277B2

(12) United States Patent
Li et al.

(10) Patent No.: US 8,109,277 B2
(45) Date of Patent: Feb. 7, 2012

(54) SMOKING ARTICLE FILTER WITH ANNULAR RESTRICTOR AND DOWNSTREAM VENTILATION

(75) Inventors: San Li, Midlothian, VA (US); Richard Jupe, Richmond, VA (US); Georgios D. Karles, Richmond, VA (US); Dwight Williams, Powatan, VA (US); Raquel Olegario, Richmond, VA (US); Michael Braunshteyn, Richmond, VA (US); Martin Garthaffner, Chesterfield, VA (US); Rowland W. Dwyer, Richmond, VA (US)

(73) Assignee: Philip Morris USA Inc,, Richmond, VA (US)

( * ) Notice: Subject to any disclaimer, the term of this patent is extended or adjusted under 35 U.S.C. 154(b) by 1007 days.

(21) Appl. No.: 12/073,543

(22) Filed: Mar. 6, 2008

(65) Prior Publication Data

US 2008/0216848 A1 Sep. 11, 2008

Related U.S. Application Data

(60) Provisional application No. 60/905,831, filed on Mar. 9, 2007.

(51) Int. Cl.
*A24D 3/04* (2006.01)

(52) U.S. Cl. ..... 131/339; 131/334; 131/336; 131/332; 131/345

(58) Field of Classification Search ..... None
See application file for complete search history.

(56) References Cited

U.S. PATENT DOCUMENTS

| | | | |
|---|---|---|---|
| 2,511,898 | A | 6/1950 | Brothers |
| 2,547,119 | A | 4/1951 | Henderson |
| 2,592,553 | A | 4/1952 | Frankenburg et al. |
| 2,592,554 | A | 4/1952 | Frankenburg |
| 2,598,680 | A | 6/1952 | Frankenburg |
| 2,764,513 | A | 9/1956 | Brothers |
| 2,769,734 | A | 11/1956 | Bandel |
| 2,954,772 | A | 10/1960 | Lebert |
| 2,954,778 | A | 10/1960 | Lebert |
| 2,954,783 | A | 10/1960 | Lebert |
| 2,954,786 | A | 10/1960 | Lebert |
| 3,098,492 | A | 7/1963 | Wurzburg et al. |
| 3,234,949 | A | 2/1966 | White et al. |
| 3,236,244 | A | 2/1966 | Irby, Jr. et al. |
| 3,255,760 | A | 6/1966 | Selke |

(Continued)

FOREIGN PATENT DOCUMENTS

BE 679657 A 10/1966

(Continued)

OTHER PUBLICATIONS

Partial International Search Report mailed Nov. 11, 2008 for PCT/IB2008/001383.

(Continued)

*Primary Examiner* — Richard Crispino
*Assistant Examiner* — Michael J Felton
(74) *Attorney, Agent, or Firm* — Buchanan Ingersoll & Rooney PC

(57) ABSTRACT

A smoking article includes a tobacco rod adapted to produce mainstream smoke, and a filter having an upstream end portion and a downstream end portion. The filter includes a ventilated cavity and a flow restrictor segment having an impermeable insert at least partially surrounded by a tubular segment of an air transmissive material upstream of the cavity. In an embodiment, the tubular segment at least partially defines the cavity.

20 Claims, 6 Drawing Sheets

U.S. PATENT DOCUMENTS 3,283,762 A 11/1966 Kissel
3,292,635 A 12/1966 Kolodny
3,318,312 A 5/1967 Curtis, Jr.
3,323,525 A 6/1967 Miller
3,356,094 A 12/1967 Ellis et al.
3,389,705 A 6/1968 Levavi
3,395,713 A 8/1968 Ent-Keller
3,441,028 A 4/1969 Wall
3,457,927 A 7/1969 Siragusa
3,496,945 A 2/1970 Tomkin
3,504,677 A 4/1970 Doppelt
3,581,748 A 6/1971 Cameron
3,599,646 A 8/1971 Berger et al.
3,630,210 A 12/1971 Haslam
3,637,447 A 1/1972 Berger et al.
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Jan Van Tilburg
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,585,015 A 4/1986 Silberstein
4,617,946 A 10/1986 Keith
4,620,553 A 11/1986 Bale et al.
4,622,982 A 11/1986 Gaisch et al.
4,637,409 A 1/1987 Berger
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A 12/1988 Kupper et al.
4,793,365 A 12/1988 Sensabaugh et al.
4,867,182 A 9/1989 Roberts et al.
4,896,682 A 1/1990 Liew
4,924,886 A 5/1990 Litzinger
4,942,887 A 7/1990 Abdelgawad et al.
4,949,736 A 8/1990 Roberts et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,345,625 B1 2/2002 Chew
6,502,580 B1 1/2003 Luparini
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 8/2004 Dante
2004/0261807 A1 12/2004 Dube et al.
2005/0066981 A1 3/2005 Crooks et al.
2006/0201524 A1 9/2006 Zhang et al.
2007/0169785 A1 7/2007 Gedevanishvili et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0017204 A1 1/2008 Braunshteyn et al.
2008/0035162 A1 2/2008 Braunshteyn et al.
2008/0047571 A1 2/2008 Braunshteyn et al.
2008/0163877 A1 7/2008 Zhuang et al.
2008/0216850 A1 9/2008 Li et al.
2008/0216851 A1 9/2008 Olegario et al.
2008/0216853 A1 9/2008 Li et al.
2010/0288293 A1 11/2010 Slasli et al.

FOREIGN PATENT DOCUMENTS

BE 1000454 A4 12/1988
EP 0364256 A 4/1990
FR 2873899 A 2/2006

| | | | |
|---|---|---|---|
| GB | 1058342 | A | 2/1967 |
| GB | 2100573 | A | 1/1983 |
| WO | WO 02/03819 | A | 1/2002 |
| WO | WO 2006/070289 | A | 7/2006 |

OTHER PUBLICATIONS

International Search Report and Written Opinion mailed Feb. 24, 2009 for PCT/IB2008/001383.

Written Opinion dated Aug. 5, 2004 for International Application No. PCT/US04/04530.

International Search Report and Written Opinion for PCT/IB2007/004224 dated Jun. 13, 2008.

International Preliminary Report on Patentability mailed Sep. 15, 2009 for PCT/IB2008/001383.

International Search Report mailed Sep. 13, 2010 for International Application No. PCT/EP2010/003016.

SMOKING ARTICLE FILTER WITH ANNULAR RESTRICTOR AND DOWNSTREAM VENTILATION

CROSS REFERENCE TO RELATED APPLICATION

This application claims priority under 35 U.S.C. §119(e) to U.S. provisional Application No. 60/905,831, filed on Mar. 9, 2007, the entire content of which is incorporated herein by reference.

DETAILED DESCRIPTION OF PREFERRED EMBODIMENTS

Presently disclosed embodiments provide the benefit of a highly ventilated smoking article with desired amounts of resistance to draw and/or provisions for facilitating high speed cigarette manufacturing utilizing high speed filter rod and cigarette making equipment.

Figure 1A:
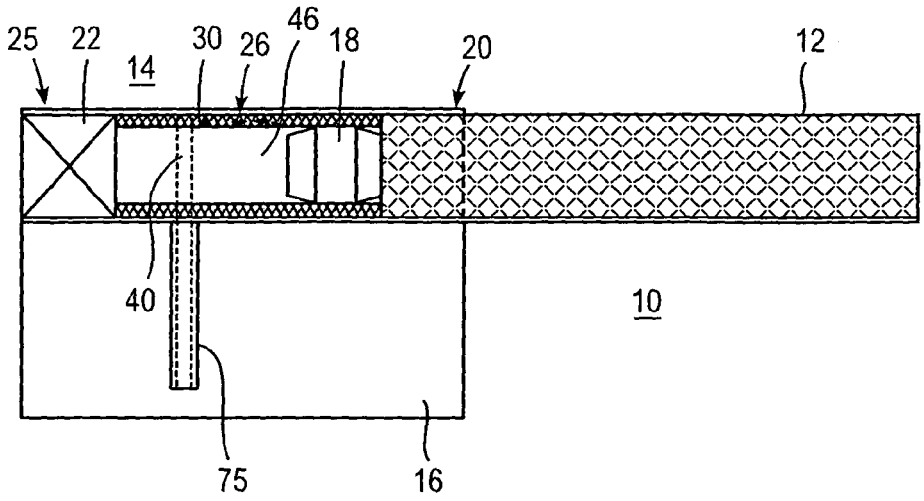
FIG. 1A is a side view of a smoking article including a filter having a flow restricting filter segment of a preferred embodiment, wherein the filter tipping paper has been partially unfolded to reveal internal filter components.

Referring now to FIG. 1A, a preferred embodiment provides a smoking article 10 comprising a tobacco rod 12 and a filter 14 connected with the tobacco rod 12 by a tipping paper 16. Preferably, the filter 14 comprises an upstream end portion 20 of the tipping paper 16, a mouthpiece filter segment 22 at a downstream end portion 25 of the filter 14, and an annular flow restricting filter segment 26 situated between the mouthpiece filter segment 22 and the upstream end portion 20 of the filter 14.

Figure 1B:
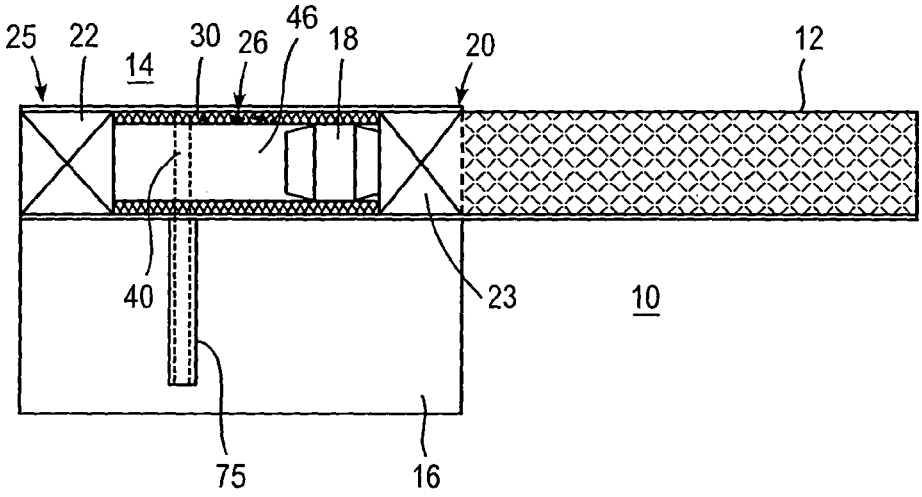
FIG. 1B is a side view of a smoking article including a filter having a flow restricting filter segment and an upstream filter segment, wherein the filter tipping paper has been partially unfolded to reveal internal filter components.

In an embodiment, as shown in FIG. 1B, a second, upstream filter segment 23 is optionally located upstream of the flow restricting filter segment 26. Preferably, the mouth filter segment 22 and the optional upstream filter segment 23 are low particulate efficiency filter segments preferably constructed from cellulose acetate tow of about 5.0 denier per filament to about 25 denier per filament (e.g. 6.0 denier, 7.0 denier, 8.0 denier, 9.0 denier, 10.0 denier, 11.0 denier, 12.0 denier, 13.0 denier, 14.0 denier, 15.0 denier, 16.0 denier) and approximately 10,000 to approximately 50,000 total denier (td), such as 35,000 td. Also preferably, the mouth filter segment 22 and the optional upstream filter segment 23 are each independently approximately 5 mm to approximately 10 mm in length.

Preferably, the flow restricting filter segment 26 comprises an impermeable insert 18 and an air transmissive tubular portion 30 located upstream of a cavity 46 in which smoke from tubular portion 30 mixes with air supplied by ventilation zone 40 comprised of ventilation holes 75 formed in the tipping paper 16.

In this embodiment, the tubular filter segment 30 is preferably constructed from low density cellulose acetate tow (sometimes referred to as a hollow acetate tube or HAT). Preferably, the HAT is approximately 5 mm to approximately 30 mm in length. More preferably the HAT is approximately 15 mm to approximately 25 mm in length. Also preferably, the HAT is approximately 0.5 mm to approximately 2 mm thick.

In another embodiment, the tubular portion 30 can be formed from porous foam, paper or other cellulosic materials so long as the material is air transmissive. The tube 30 can be made via other forming techniques such as molding or extruding the tube or forming a tube with a longitudinal seam. Preferably, the tubular support 30 provides desired firmness throughout length of the filter 14.

Preferably, the flow restriction filter segment 26 is configured to contribute sufficient pressure drop such that the smoking article 10 presents a resistance to draw of at least 40 mm water or greater, preferably in the range of approximately 50 mm to approximately 120 mm water. For example, the flow restrictor insert 18 can have a diameter of approximately 4.0 mm to approximately 8.0 mm and more preferably approximately 5 mm to approximately 7 mm.

In an embodiment, an insert 18 is plunged in one end of the tubular portion 30. Preferably, the insert 18 is constructed of a smoke impermeable material such as plastic, polymer or a metal. Most preferably, the insert 18 is made of a non-permeable material such as high density polyethylene (HDPE), extruded or compressed cellulosic material, and/or a closed-cell foam such as paper-foam, tobacco foam, and/or polyethylene foam. The insert 18 is impermeable to smoke so as to force drawn smoke to flow around the insert 18 and through the permeable tubular portion 30.

In a preferred embodiment, the impermeable material used to form the insert 18 is flavored. Examples of flavorants include licorice, sugar, isosweet, cocoa, lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, sage, spearmint, ginger, coriander, coffee and the like.

In this embodiment, the insert 18 has tapered ends with end to end symmetry that facilitates high speed filter rod making because the insert 18 works the same whether or not the rod making machine orients one end of the device first or reverses it.

Preferably, the cavity 46 is defined by an inner periphery of the tubular segment 30, and the open space between the upstream end of the mouthpiece segment 22 and the downstream end of the insert 18. The ventilation zone 40 communicates with the cavity 46 at a location downstream of the flow restrictor insert 18.

In this embodiment, the ventilation zone 40 comprises a plurality of ventilation holes which extend through the tipping paper 16. Because the tubular segment 30 is formed by an air transmissive material, perforations need not be made in and/or extend through the tubular filter segment 30. This arrangement facilitates the use of online laser perforation techniques to provide ventilation holes during the manufacture of the smoking article 10.

Manufacture of the smoking articles 10 described above can be facilitated with the use of pre-perforated tipping paper.

The ventilation zone 40 is established with a first circumferential row (and optionally second and possibly third rows) of ventilation holes through the tipping paper 16 and optionally the filter tube 30. Accordingly, air is preferably drawn through the ventilation holes of the ventilation zone 40 and into the cavity 46 defined between the flow restrictor insert 18 and the mouthpiece filter segment 22.

Preferably the ventilation zone 40 is located at a downstream location near or adjacent to the flow restriction filter segment 26 so that air drawn through the ventilation zone 40 is allowed to mix with the mainstream smoke in the cavity 46 before arriving at the mouthpiece filter 22.

Preferably, the distance between the ventilation zone 40 and the mouthpiece filter 22 is at least 5 mm or in the range of approximately 5 mm to approximately 20 mm.

Preferably, the ventilation zone 40 achieves a ventilation level of the smoking article of at least about 25% and more preferably at least about 50% to about 90%, e.g. 60%, 70%, or 80%.

Optionally, a second zone of ventilation may be located upstream of the flow restriction filter segment 26 in addition to the downstream ventilation zone 40 as described above.

Preferred dimensions for an 83 mm smoking article include, for example, a filter length of 27 mm, a mouth end filter segment length of 7 mm, vent holes 12 mm from the mouth end of the smoking article, a tubular portion length of 13 mm, an insert length of 5 mm, and an upstream cellulose acetate filter segment length of 7 mm.

Figure 2:
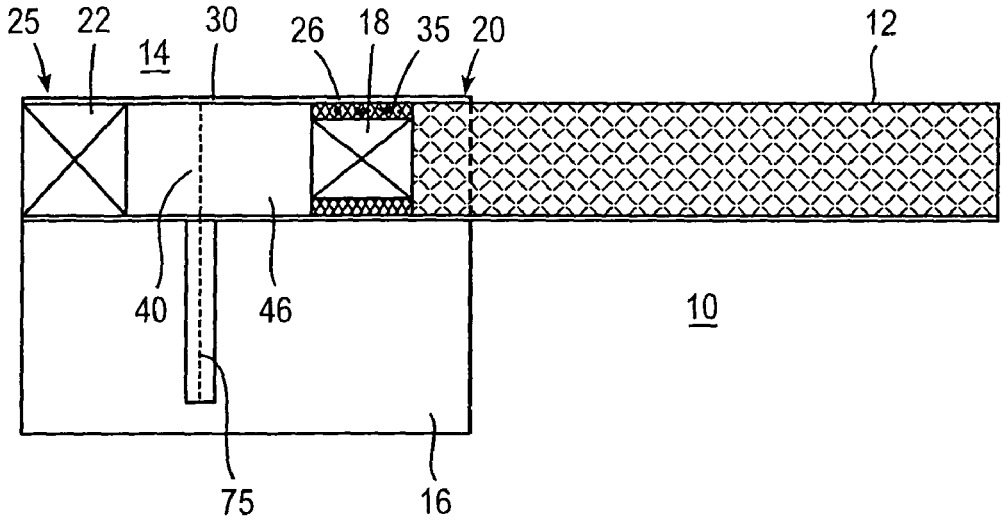
FIG. 2 is a side view of a smoking article including a filter having a flow restricting filter segment of a preferred embodiment, wherein the filter tipping paper has been partially unfolded to reveal internal filter components.
Figure 3:
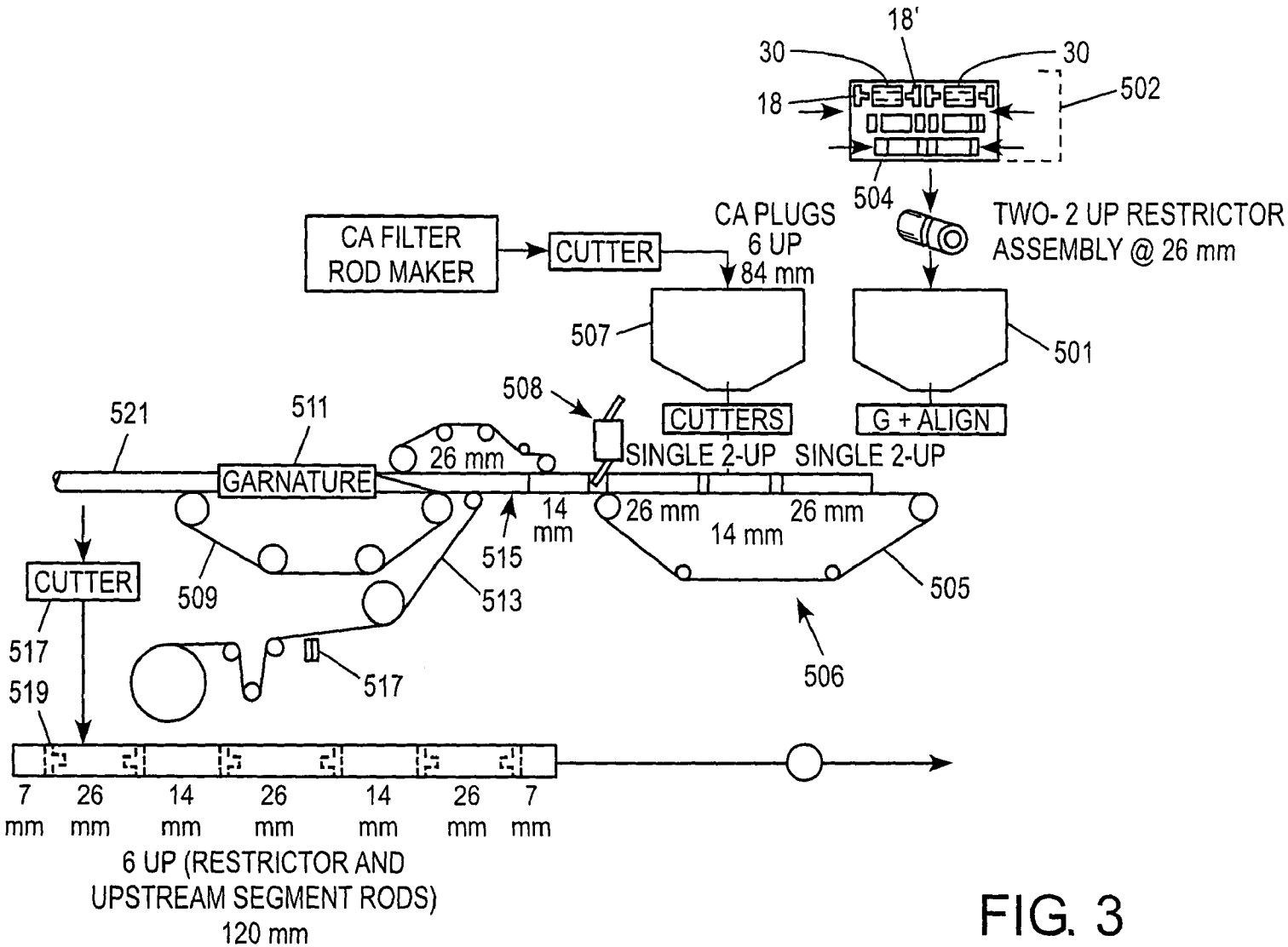
FIG. 3 provides a general representation of DAPTC combiner arranged to perform combining steps of a preferred method of manufacturing the smoking article.

Referring now to FIG. 2, a smoking article 10 includes a tobacco rod 12 and a filter 14. Preferably, the filter 14 includes a flow restricting filter segment 26 adjacent the upstream end portion 20 of the tipping paper 16. Preferably, the flow restricting filter segment 26 has a length of approximately 3 mm to approximately 10 mm, more preferably approximately 3 mm to approximately 7 mm in length.

In a preferred embodiment, the flow restricting filter segment 26 includes an insert 18 at least partially surrounded by an air transmissive material 35 such as HAT. In this embodiment, the flow restricting filter segment 26 is upstream of a cavity 46 and a ventilation zone 40. The cavity is defined by an inner periphery of a tubular segment 30. The cavity 46 is further defined by the open space between the upstream end of the mouthpiece filter segment 22 and the downstream insert 18. The mouthpiece filter segment 22 and restrictor segment 26 are contained within the tubular portion 30. The tubular portion 30 is defined by a thick, stiff paper wrap, such as Parliament® type paper. Preferably, flow restricting filter segment 26 is in a condition of being plunged in the tubular portion 30.

In this embodiment, the insert 18 has end-to-end symmetry, and is plunged into the short hollow acetate tube 35 that is substantially the same length as the insert 18. Because the insert 18 is impermeable, smoke drawn through the filter is diverted through the air transmissive material of HAT 35, and around the flow restrictor insert 18 and into the cavity 46.

Preferably, the flow restriction filter segment 26 and the mouthpiece filter 22 are spaced by a distance sufficient to reduce impaction of particulate smoke components upon the upstream face of the mouthpiece filter 22. Preferably, the flow restriction segment 26 is spaced approximately 4 mm to approximately 20 mm from the mouthpiece filter segment 22, more preferably the flow restriction segment 26 is spaced approximately 5 mm to approximately 15 mm from the segment 22.

In a preferred embodiment, the filter may be constructed from simple combining techniques typically used in the industry for manufacturing cigarettes at high speeds.

In the FIG. 2 embodiment, a desired amount of resistance to draw can be achieved while maintaining the desired degree of high ventilation throughout the puff count. The latter attribute is achieved by placement of the ventilation zone 40 downstream of the flow restrictor 26. By placing the ventilation zone 40 in spaced apart relation to the mouthpiece filter plug 22, mixing of air drawn into the filter 14 through the ventilation zone 40 with mainstream smoke drawn from the tobacco rod 12 is facilitated.

During smoking, good mixing is evidence by production of uniform stain patterns at the buccal end of the mouthpiece filter 22.

During a puff, mainstream smoke is drawn through around the insert 18, through the air transmissive material 35 of the tubular portion, and into the cavity 46 where it is mixed with ventilation air that is drawn into the cavity 46 via the ventilation zone 40.

In a preferred embodiment, the ventilation zone 40 comprises a plurality of ventilation holes 75, which extend through the tipping paper 16, and optionally, partially into or through the tubular segment 30. This arrangement facilitates the use of online laser perforation techniques to provide ventilation holes 75 during the manufacture of the smoking article 10. Other techniques may be used to create the ventilation zone 40 such as using off-line, pre-perforated tipping paper, mechanical perforation, electrostatic perforation and other techniques.

FIGS. 3-6 illustrate an exemplary method of manufacturing smoking articles including the flow restriction filter segment 26 of FIG. 1B. Along flutes of a drum 504 pairs of HAT segments 30 are each respectively situated between opposing pairs of 2-up inserts 18, 18' and are pushed together so that a pair of 2-up HAT restrictor assemblies are established on each flute, which assemblies are each 26 mm long. The pairs are then fed or placed into a first hopper 501 of an upstream section 506 of a DAPTC combiner. From the first hopper 501, the 2-up HAT restrictor assemblies are separated and fed in spaced apart relation onto an endless feed belt 505 of the DAPTC combiner.

Similarly, continuous cellulose acetate filter rods are produced and cut into a plurality of CA 6-up/84 mm long rods, which are fed or placed into a second hopper 507 of the DAPTC combiner. During combining operations the 6-up rods are further cut and sorted into 2-up/14 mm segments and placed in alternating relation to the restrictor assemblies on the feed belt 505.

At the downstream travel portion of the feed belt 505 a rotating spacer drum 508 establishes a continuous, closed-up procession 515 of the alternating 2-up restrictor assemblies and 2-up CA segments in mutually abutting, end to end relation with one after another. Downstream of the rotating spacer drum 508, the procession is transferred onto a ribbon of plug wrap 513. A garniture belt 509 draws both the procession 515 and the plug wrap 513 through a garniture 511 whereat a plug wrap 513 is wrapped about the procession of plugs 515 so as to form a continuous filter rod 521. Preferably one or more glue guns 517 apply a desired pattern of glue continuously and/or at spaced locations along the ribbon of plug wrap 513 to retain filter rod 521 in its final form.

Downstream of the garniture 511 a cutter 517 severs the continuous rod 521 so as to form a 6-up restrictor/upstream segment assembly (rod) 519. The 6-up rod 519 preferably comprises the following segments from one end to the other: a 1-up/7 mm CA segment; a first 26 mm/2-up restrictor assembly segment; a 14 mm/2-up CA segment; a second 26 mm/2-up restrictor assembly segment; a second 14 mm/2-up CA segment; a third 26 mm/2-up restrictor assembly segment; and a second, 1-up/7 mm. The 6-up rods 519 are then fed or placed into a first hopper 170 of the dual hopper max.

Figure 4:
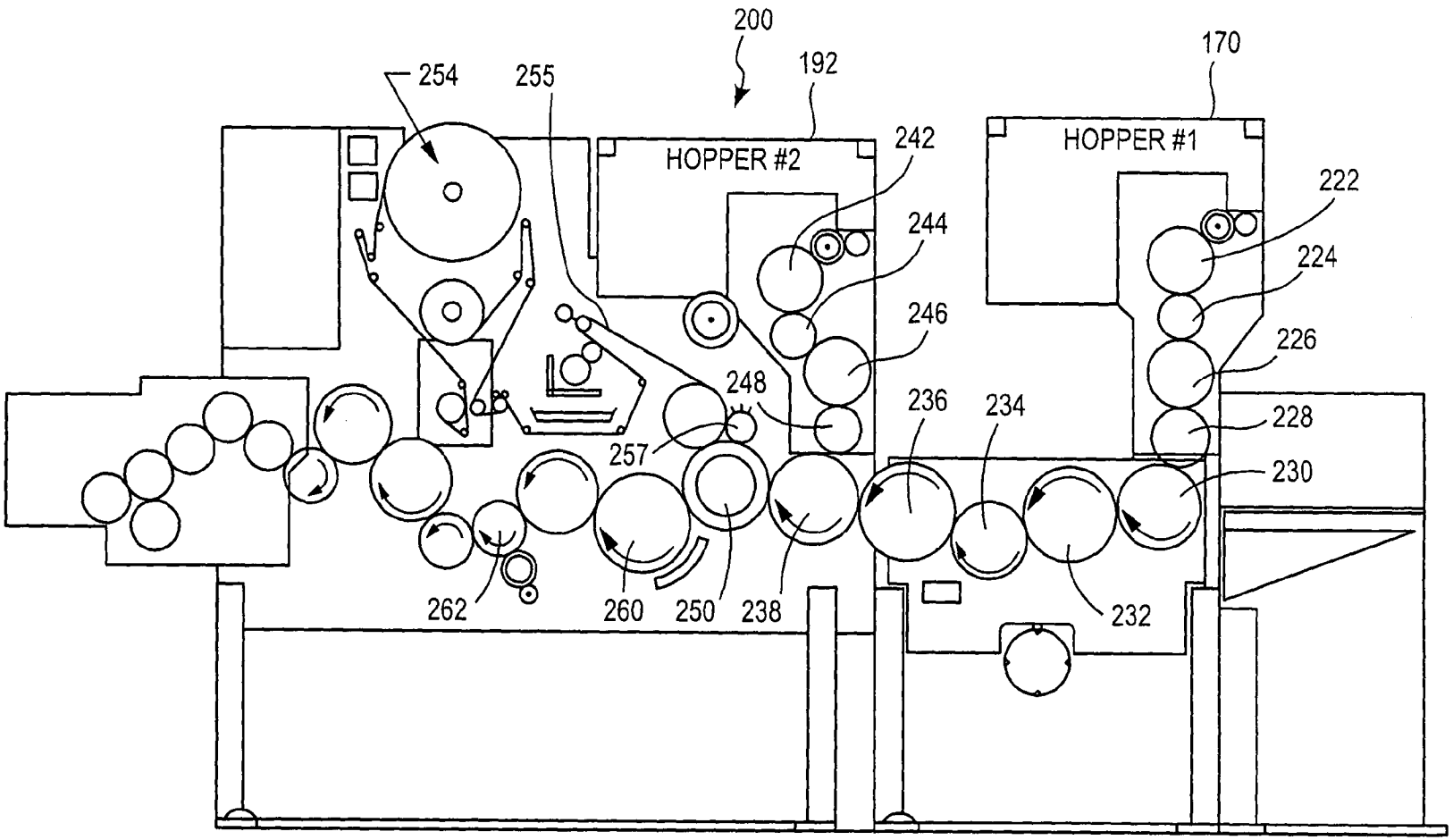
FIG. 4 is a representation of a dual hopper max (DH MAX) which has been adapted to conduct certain further filter combining operations on its drums and to tip pairs of tobacco rods with the resultant combined filters.
Figure 5:
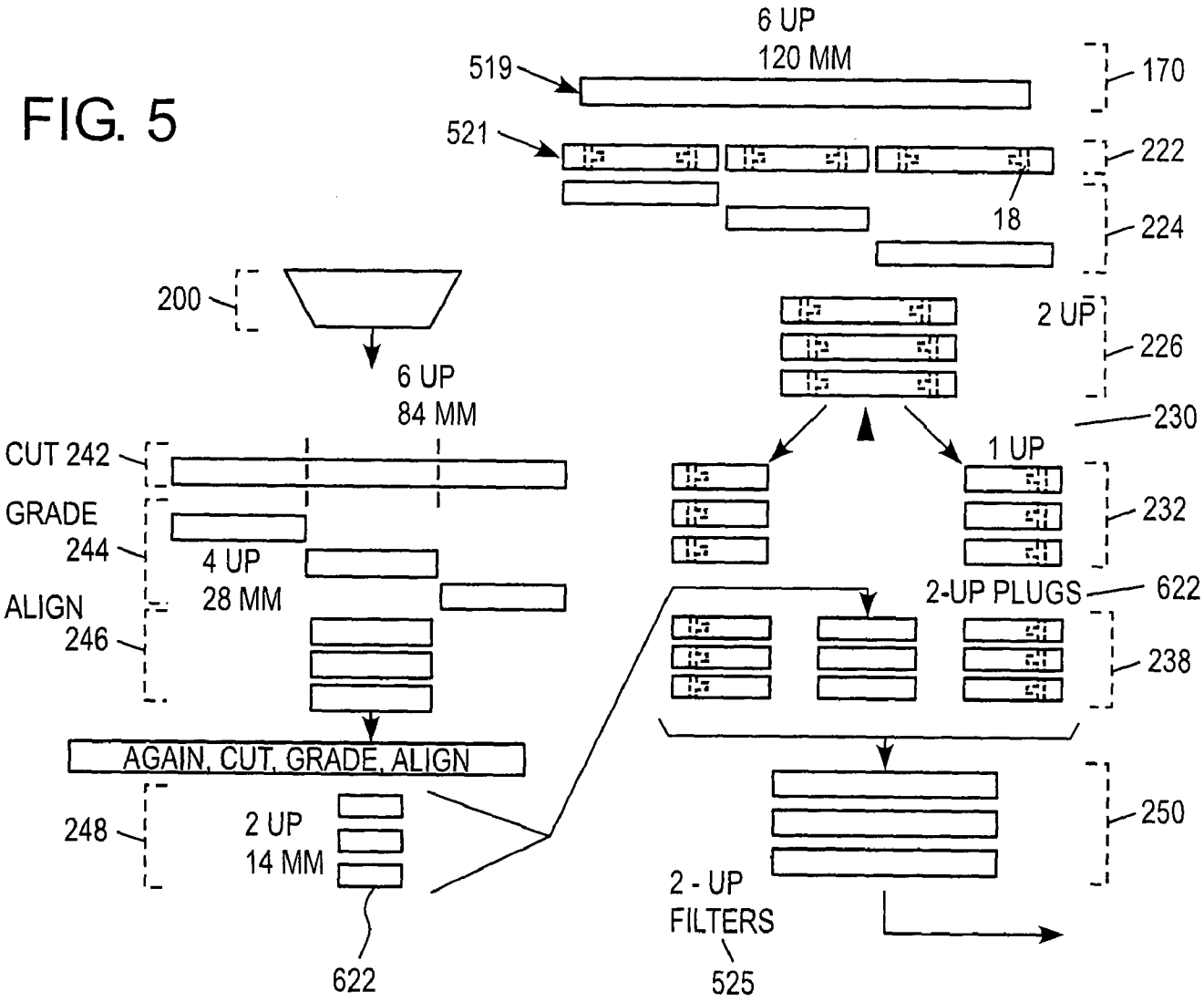
FIGS. 5 and 6 are representations of those further combining steps and tipping operations that are performed on the DH MAX.

Referring now to FIGS. 4 and 5, the 6-up/120 mm rods 519 are then cut into three 2-up rods 521 at drum 222, then graded at drum 224 aligned at drum 226, whereupon each are cut centrally and spaced apart into opposing pairs of sub-assemblies along each flute of the drum 232. Each sub-assembly comprises a 1-up/7 mm CA segment (corresponding to the upstream segment 23 in FIG. 1B), an insert 18 and a 1-up HAT segment, whose open end portion is directed inwardly along the respective drum flute. The pairs of sub-assemblies are spaced apart sufficiently to receive 2-up/14 mm CA plugs 523.

The 2-up plugs 523 are constructed from similar cutting grading and aligning operations on 6-up 84 mm long filter rods at drums 242, 244 and 246 of the DH MAX represented in FIG. 4, with further cut, grade and align operations occurring at or about the drum 248.

Figure 6:
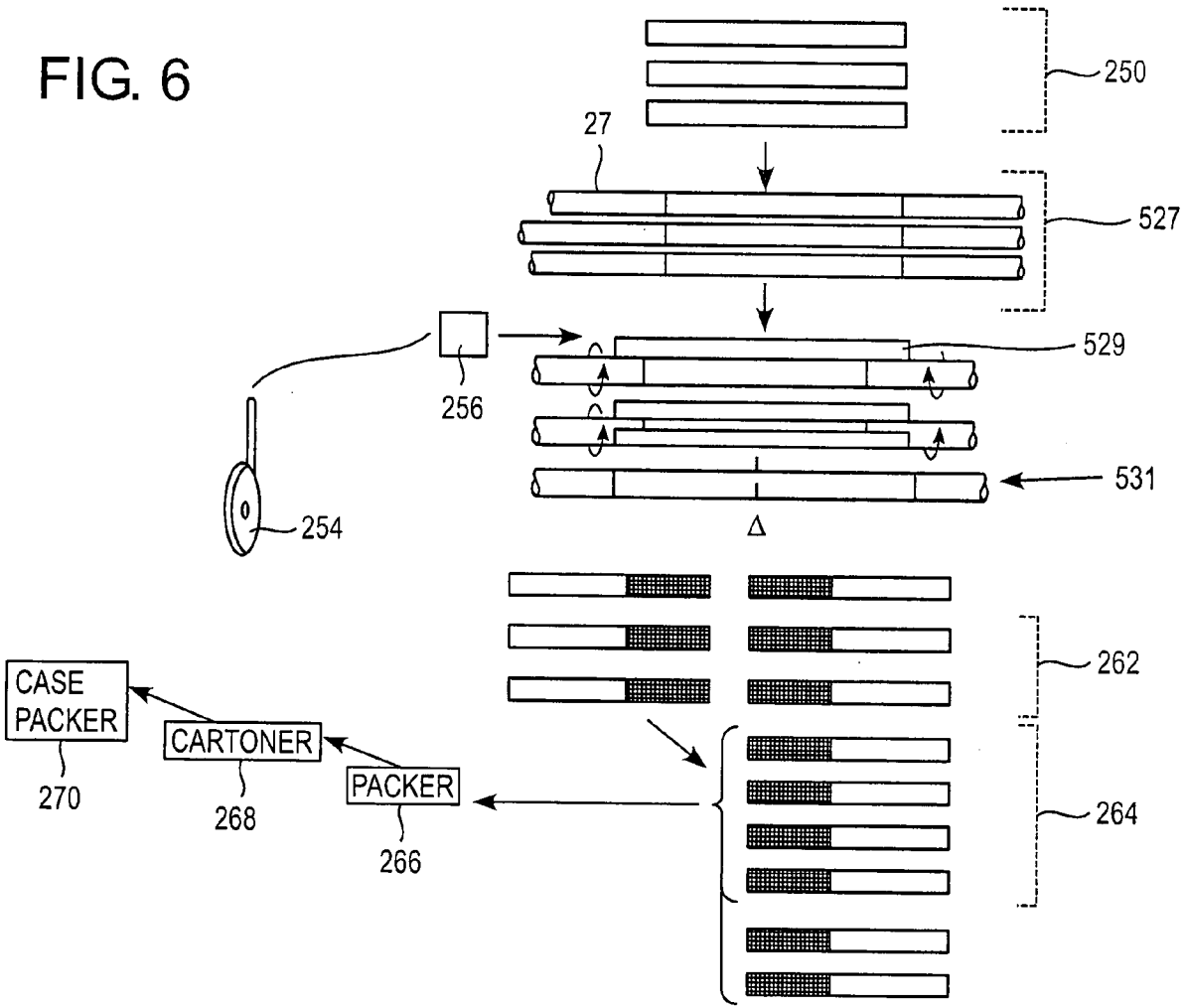

Referring back to operations at 238, the plugs are brought together at drum 250 to form a complete 2-up filter structure 525, which are then fed in between pairs of spaced apart filter rods 527, as illustrated in FIG. 6, and wrapped with tipping paper 529 in accordance with the usual tipping operations of a dual hopper max to form a completed 2-up cigarette structure 531. Thereafter, the 2-up cigarette structure 531 is severed and the cigarettes are all aligned at drum 264 whereupon they are directed to a packer 266 from whence they go to a cartoner 268 and to a case packer 270.

In an embodiment, flavorants or colorants can be added to the material surrounding the flow restriction device 26. Examples of flavorants include licorice, sugar, isosweet, cocoa, lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, coffee and the like.

The embodiments as shown and described herein provide the benefit of a highly ventilated smoking article with desired amounts of resistance to draw and provisions for facilitating high-speed cigarette manufacturing on conventional cigarette making equipment.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. For example, other air-permeable materials could be used to construct the HAT. Accordingly, the exemplary embodiments, as well as alternative embodiments, may be made without departing from the spirit and scope of the articles and methods as set forth in the attached claims.

We claim:

1. A smoking article comprising:

a tobacco rod adapted to produce mainstream smoke;

a filter operative with said tobacco rod, said filter having an upstream end portion and a downstream end portion, said filter comprising:

a central cavity located between said upstream end portion and said downstream end portion;

a flow restricting filter segment located upstream of said cavity and including an impermeable insert surrounded by a tubular segment of an air transmissive material; and a ventilation zone at a location along said cavity and downstream of said flow restricting segment, said ventilation zone in communication with said cavity.

2. The smoking article of claim 1, wherein the tubular segment has a length equal to or exceeding a length of the insert.

3. The smoking article of claim 1, wherein said air transmissive material is selected from the group consisting of a hollow acetate tube, carbon on tow, carbon paper, thick and/or heavy paper, and combinations thereof.

4. The smoking article of claim 1, wherein said insert is in a condition of having been plunged into said tubular segment.

5. The smoking article of claim 1, wherein said tubular segment at least partially defines said cavity.

6. The smoking article of claim 1, wherein said insert is fully contained within said tubular segment.

7. The smoking article of claim 1, wherein said insert has a sliding fit with said tubular segment.

8. The smoking article of claim 1, wherein said insert is coextensive with the filter length and/or there is no filtering material between the flow restricting filter segment and a downstream end of the tobacco rod.

9. The smoking article of claim 1, wherein said filter and tobacco rod are attached with tipping paper and wherein said ventilation zone is defined by at least one row of perforations in said tipping paper.

10. The smoking article of claim 1, wherein said smoking article includes an optional first filter plug upstream of said flow restricting filter segment and a second filter plug at a mouth end of said filter.

11. The smoking article of claim 10, wherein at least one of said first filter plug segment and said second filter plug segment comprises cellulose acetate tow of about 5 denier to about 25 denier per filament.

12. The smoking article of claim 1, wherein the predetermined resistance-to-draw of said smoking article is approximately 40 millimeters water or above.

13. The smoking article of claim 1, wherein said insert is formed from a material selected from high density polyethylene, polypropylene, nylon, compressed or extruded cellulosic material, closed cell foams, and/or combinations thereof.

14. The smoking article of claim 1, wherein said insert includes at least one flavorant.

15. The smoking article of claim 1, wherein said insert has end-to-end symmetry.

16. The smoking article of claim 1, wherein said insert includes an impermeable end wall.

17. The smoking article of claim 1, wherein said insert is a solid plug press fitted into a hollow acetate tube.

18. The smoking article of claim 1, wherein said insert is injection molded.

19. The smoking article of claim 1, wherein said smoking article has a ventilation level at least about 25%.

20. The smoking article of claim 1, wherein said smoking article has a ventilation level at least about 50% to about 90%.

* * * * *